US006893279B2

(12) United States Patent
Lott et al.

(10) Patent No.: US 6,893,279 B2
(45) Date of Patent: May 17, 2005

(54) DEVICE FOR PREVENTING A VIBRATION-LOADED SEAL FROM SHIFTING

(75) Inventors: Thomas Lott, Buehl (DE); Rainer Becker, Beinheim (FR); Michael Speth, Bartholomae (DE); Christian Meyer, Groetzingen (DE)

(73) Assignee: Robert Bosch GmbH, Stuttgart (DE)

( * ) Notice: Subject to any disclaimer, the term of this patent is extended or adjusted under 35 U.S.C. 154(b) by 26 days.

(21) Appl. No.: 10/276,147

(22) PCT Filed: Apr. 5, 2001

(86) PCT No.: PCT/DE01/01322

§ 371 (c)(1),
(2), (4) Date: Jun. 2, 2003

(87) PCT Pub. No.: WO01/89039

PCT Pub. Date: Nov. 22, 2001

(65) Prior Publication Data

US 2004/0092161 A1 May 13, 2004

(30) Foreign Application Priority Data

May 13, 2000 (DE) ..... 100 23 587

(51) Int. Cl.[7] ..... H01R 13/52
(52) U.S. Cl. ..... 439/271

(58) Field of Search ..... 439/271, 587, 439/589, 272, 559; 277/628, 630

(56) References Cited

U.S. PATENT DOCUMENTS

| | | | | |
|---|---|---|---|---|
| 4,743,210 A | | 5/1988 | Schild | 439/559 |
| 5,759,064 A | * | 6/1998 | Sugiyama | 439/548 |
| 5,785,543 A | * | 7/1998 | Dietrich | 439/271 |
| 5,870,833 A | * | 2/1999 | Van Bebber et al. | 33/554 |
| 6,428,368 B1 | * | 8/2002 | Hawkins et al. | 439/271 |

FOREIGN PATENT DOCUMENTS

| | | |
|---|---|---|
| DE | 37 33 156 C | 11/1988 |
| DE | 297 10 984 U | 8/1997 |
| DE | 197 29 096 A | 9/1998 |

* cited by examiner

*Primary Examiner*—Briggitte R. Hammond
(74) *Attorney, Agent, or Firm*—Ronald E. Greigg

(57) ABSTRACT

The invention relates to a device for preventing shifting of a vibration-loaded seal retained between two components braced against one another with the aid of clamping means, in particular to prevent shifting of a seal retained between a plug strip and a housing half shell of a motor vehicle clutch control element. This device includes stop faces for the seal, which act in a plane essentially perpendicular to the pre-stressing direction and which are embodied at least in part on the clamping means.

8 Claims, 3 Drawing Sheets

DEVICE FOR PREVENTING A VIBRATION-LOADED SEAL FROM SHIFTING

CROSS-REFERENCE TO RELATED APPLICATIONS

This application is a 35 USC 371 application of PCT/DE 01/01322 filed on Apr. 5, 2001.

BACKGROUND OF THE INVENTION

1. Field of the Invention

The invention is based on a device for preventing shifting of a vibration-loaded seal, which is retained between two components braced against one another with the aid of clamping means, in particular to prevent shifting of a seal retained between a plug strip and a housing half shell of a motor vehicle clutch control element.

2. Description of the Prior Art

A known clutch control element for engagement and disengagement of a vehicle clutch, in accordance with the German Patent Disclosure DE 197 01 739 A1, is integrated with a two-shell housing, which comprises two housing half shells, that are pivotable about a pivot axis relative to one another, so that two flanges formed onto each housing half shell rest on one another, with the interposition of a seal. An electric motor for driving a tappet is received in one of the housing half shells and is in contact with a piston of a hydraulic transducer cylinder. For supplying external electric power to the electric motor, electric plug connections are necessary, which are embodied for instance by a plug strip, whose head protrudes from an opening in a wall of a housing half shell. In that case, the dustproof and moistureproof sealing off of the interior of the housing from the environment must be provided by a seal subject to initial tension between the plug strip head and the housing wall.

Such clutch control elements are sometimes exposed to considerable vehicle vibration and therefore despite the prestressing there is the risk that the seal, because of the vibrational load, will shift over time in a plane perpendicular to the prestressing direction. Because in that case it can no longer be assured that the seal will rest on the sealing faces associated with it of the adjoining components, impairments in the sealing action can occur.

SUMMARY OF THE INVENTION

In accordance with the invention stop faces form a barrier that reliably prevents shifting of the seal. Because they are in part embodied on the already existing clamping means, no additional parts are needed, making the production costs correspondingly low.

In provisions that are especially preferred, one component is a plug strip, and the other component is a housing half shell of a motor vehicle clutch control element; the plug strip is preferably retained parallel to one edge of the housing half shell, at which edge a top wall, provided with an opening for a plug strip head, abuts against a side wall extending perpendicular to the top wall. The seal is a ring seal, surrounding the plug strip head, which seal is fastened between a shoulder of the plug strip and an inner circumferential rim of the opening in the top wall of the housing half shell. The clamping means include at least one plug-in wedge, supported on the housing half shell, that tapers in wedgelike fashion toward its free end and is insertable into an opening, extending transversely to the prestressing direction, of the plug strip in such a way that a prestressing force that is greater, the greater the insertion depth is, can be exerted on the plug strip and the ring seal.

The plug-in wedge protrudes away from a side face, pointing toward the plug strip, of a clamping bracket, which is supported on the housing half shell counter to the action of the prestressing force because of the fact that on each of its two ends, a retaining peg is provided, which on the one hand is guided in a groove embodied in the plug strip and on the other is checked by a respective hook protruding downward from the top wall of the housing half shell.

In that case, in a preferred embodiment, the stop faces on the one hand contain stop strips, which are formed onto the clamping bracket and are disposed successively along its length in spaced-part fashion and contact an outer circumferential surface of the ring seal or are located opposite it at a slight spacing. On the other hand, support ribs embodied on the side wall of the housing half shell are provided, which are disposed parallel to the plug strip, spaced apart from and aligned with another.

By means of the other provisions recited in the dependent claims, advantageous refinements of and improvements to the invention defined by claim 1 are possible.

BRIEF DESCRIPTION OF THE DRAWINGS

One exemplary embodiment of the invention is explained in further detail in the ensuing description, taken in conjunction with the drawings, in which.

DESCRIPTION OF THE PREFERRED EMBODIMENT

Figure 1:
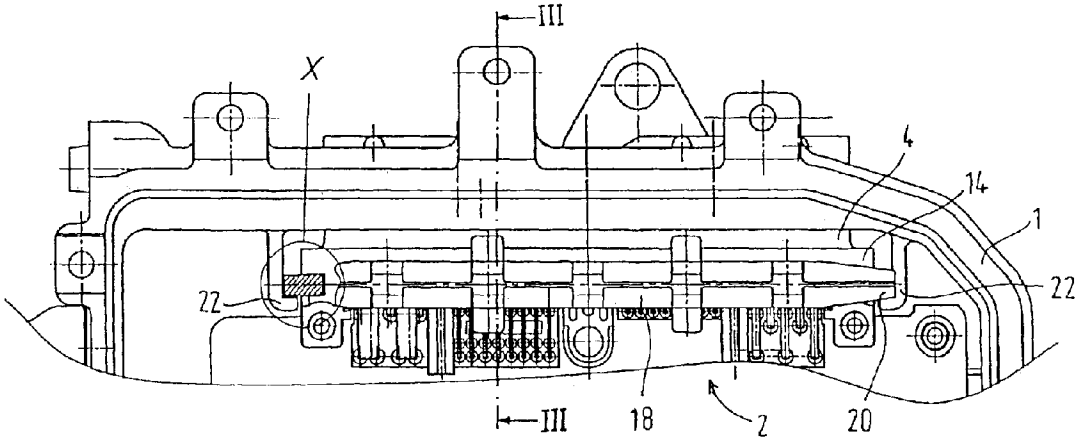
FIG. 1, a fragmentary side view of a housing half shell of a clutch control element, with a plug strip.

In FIG. 1, for reasons of scale, all that is shown of a clutch control element for engaging and disengaging a vehicle clutch are a half shell 1 of a housing that comprises two housing half shells; one exemplary embodiment of a device 2 for preventing the shifting of a vibration-loaded seal is integrated with this half shell. The function of a clutch control element of this kind is sufficiently well known, for instance from DE 197 01 739 A1, and no further explanation of it will therefore be made here.

Figure 3:
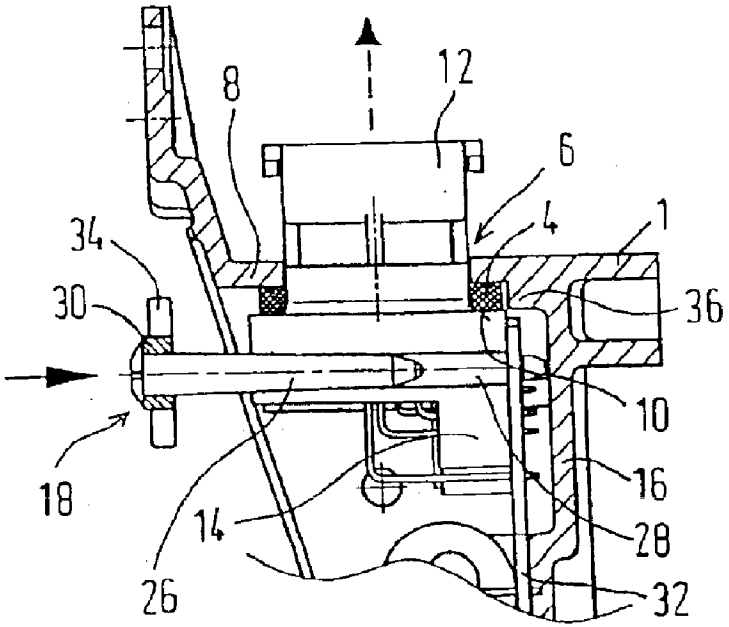
FIG. 3, a cross-sectional view taken along the line III—III in FIG. 1 during the assembly of the plug strip.

As best seen from FIG. 3, the seal is a ring seal 4, which surrounds a plug strip head 12 of a plug strip 14 that protrudes from an opening 6 in a top wall 8 of the housing half shell 1 and tapers as a result of a shoulder 10 toward the opening 6. The ring seal 4 is fastened between the shoulder 10 of the plug strip 14 and an inner circumferential rim of the opening 6 in the housing half shell 1 and thus assures sealing off of an interior of the housing from the environment. The plug strip 14 is preferably retained on one edge of the housing half shell 1, at which the top wall 8, provided with the opening 6 for the plug strip head 12, abuts a side wall 16 extending perpendicular to the top wall.

The retention or prestressing force that holds the plug strip 14 from the inside on the inner circumferential rim of the opening 6 in the housing half shell 1 and thus also prestresses the ring seal 4 is generated by clamping means, which in the preferred embodiment contain a clamping bracket 18, which extends parallel to the longitudinal direction of the plug strip 14 and whose ends, embodied as retaining pegs 20 bent at right angles, partly grip the two end faces of the plug strip 14 (FIG. 1).

Figure 2:
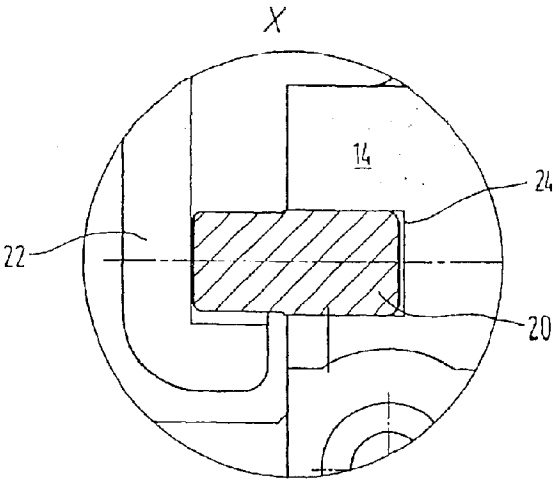
FIG. 2, an enlarged of the detail marked X in FIG. 1.

As the cross-sectional view of the enlarged detail X of FIG. 2 shows, the retaining pegs 20 of the clamping bracket 18 are braced, by a part of their bottom face, on two hooks 22 protruding parallel downward from the top wall 8 of the housing half shell 1, the hooks being disposed symmetrically to one another. On the other side, the retaining pegs 20 are also guided flush in grooves 24, disposed on the end faces of the plug strip 14 and open toward the hooks 22, so that forces acting perpendicular to the length of the grooves 24 and counter to the prestressing direction, indicated by a dashed arrow in FIG. 3, of the ring seal 4 can be absorbed by the hooks 22 of the housing half shell 1.

As shown in FIG. 3, the clamping bracket 18 has a plug-in wedge 26, which points away from the side face of the clamping bracket pointing toward the plug strip 14, the plug-in wedge preferably extending coplanar to the center plane of the clamping bracket; toward its end, the plug-in wedge tapers in wedgelike fashion. The plug-in wedge 26 can be inserted into a transverse opening 28 of the plug strip 14, which opening extends preferably transversely to the prestressing direction of the ring seal 4; the insertion direction is represented in FIG. 3 by a horizontal arrow. The transverse opening 28 of the plug strip 14 is embodied as continuous, for example.

Since the clamping bracket 18 can be braced on the hooks 22 of the housing half shell 1 by way of its two terminal retaining pegs 20, a prestressing force acting perpendicular to the insertion direction of the plug-in wedge 26 is exerted on the plug strip 14 and thus also on the ring seal 4 resting thereon, when the plug-in wedge 26 is thrust into the transverse opening 28 in the plug strip 14. Because of the wedgelike shape of the plug-in wedge, the prestressing force increases as the insertion depth increases. A set-point prestressing force is attained for instance whenever the plug-in wedge 26 is in its completely inserted terminal position, shown in FIG. 4, in which a stop collar 30 of the plug-in wedge 26 strikes the rim of the transverse opening 28 of the plug strip 14.

Because of the prestressing force generated by the plug-in wedge 26, a reaction force acts on the retaining pegs 20 of the clamping bracket 18 and forces them against the hooks 22 of the housing half shell. The clamping bracket 18 is prevented from shifting, both by the prestressing force and by the travel limitation of the second housing shell.

Since the prestressing force also acts on the ring seal 4, placed between the shoulder 10 of the plug strip 14 and the circumferential rim of the opening 6 in the housing half shell 1, and since the ring seal 4 for instance comprises a material that deforms elastically and/or plastically in response to the set-point prestressing force, the interior of the clutch control element that is surrounded by the two housing half shells is reliably sealed off from the environment.

Figure 4:
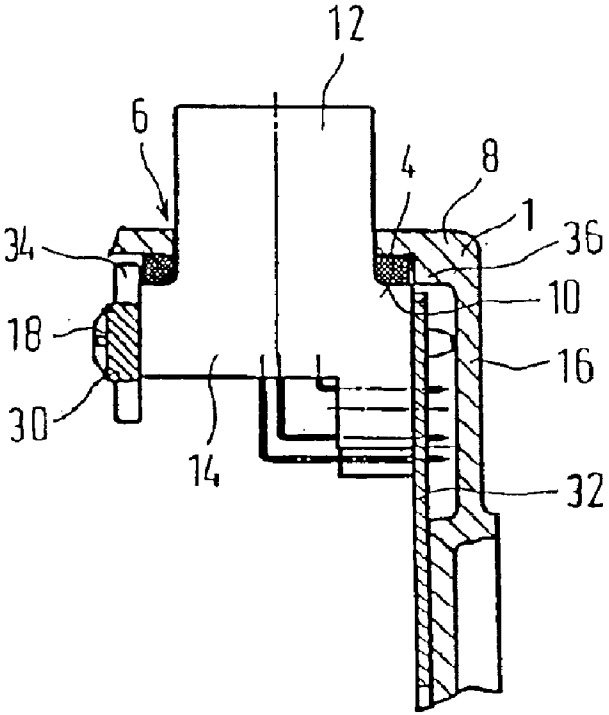
FIG. 4, a cross-sectional view of the plug strip after the assembly has been completely.

As FIG. 4 shows, the side face, pointing away from the clamping bracket 18, of the plug strip 14 is secured to a circuit board 32, which can be braced on the side wall 16 of the housing half shell 1. The plug strip 14 is thus pressed against the side wall 16 of the housing half shell 1, transversely to the prestressing direction of the ring seal 4, by the clamping bracket 18 clamped against the hook 22.

Figure 5:
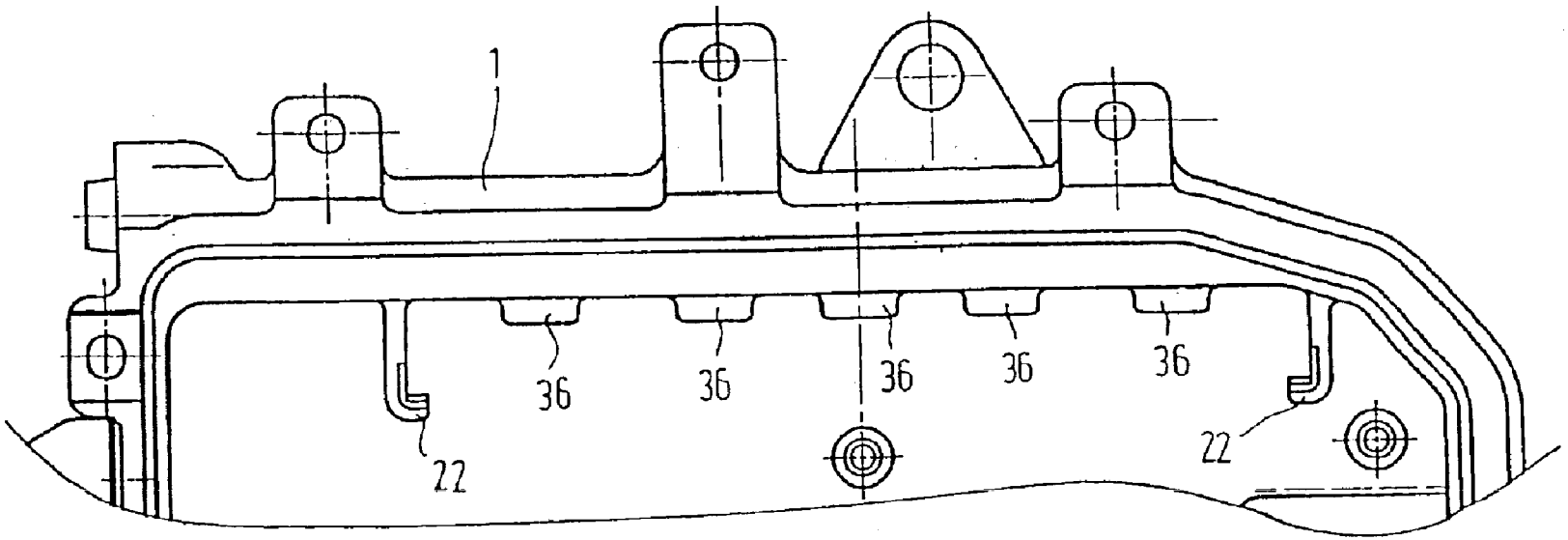
FIG. 5, the housing half shell of FIG. 1, without the plug strip.

To prevent the ring seal 4 from shifting laterally under vibration load, stop faces acting essentially perpendicular to the prestressing direction are provided for it. In the preferred embodiment, the stop faces on the one hand include stop strips 34, formed onto the clamping bracket 18, which are disposed spaced apart in line with one another along the length of the clamping bracket and contact an outer circumferential face of the ring seal 4, or are located facing the ring seal at a slight spacing from it. On the other, support ribs 36 are provided, which are embodied on the side wall 16 of the housing half shell 1 and are disposed parallel to the plug strip 14, spaced apart and aligned one after the other, as can be seen best in FIG. 5, which shows the housing half shell 1 without the plug strip 14. If the ring seal 4, despite the prestressing force acting on it, should still tend because of vibration to migrate outward in a plane perpendicular to the prestressing direction, it is then held in its position by the stop faces 34, 36.

Instead of stop faces 34, 36 disposed only intermittently along the circumference of the ring seal, these faces can also be embodied as closed faces, for instance, in a further embodiment of the invention.

The foregoing relates to preferred exemplary embodiments of the invention, it being understood that other variants and embodiments thereof are possible within the spirit and scope of the invention, the latter being defined by the appended claims.

We claim:

1. In a device for preventing shifting of a vibration-loaded seal, which is retained between two components braced against one another with the aid of clamping means to prevent shifting of a seal (4) retained between a plug strip (14) and a housing half shell (1) of a motor vehicle clutch control element, the improvement comprising stop faces (34, 36) for the seal (4), the stop faces acting in a plane essentially perpendicular to the prestressing direction and being embodied at least in part on the clamping means (18, 26), wherein the plug strip (14) is retained parallel to one edge of the housing half shell (1), at which one edge a top wall (8), provided with an opening (6) for a plug strip head (12), abuts against a sidewall (16) extending perpendicular to the top wall.

2. The device of claim 1, wherein the seal includes a ring seal (4), surrounding the plug strip head (12), which seal is fastened between a shoulder (10) of the plug strip (14) and an inner circumferential rim of the opening (6) in the top wall (8) of the housing half shell (1).

3. The device of claim 2, wherein the clamping means include at least one plug-in wedge (26), supported on the housing half shell (1), the plug-in wedge tapering in wedgelike fashion toward its free end and being insertable into an opening (28), extending transversely to the prestressing direction, of the plug strip (14) in such a way that a prestressing force that increases with increased insertion depth can be exerted on the plug strip (14) and the ring seal (4).

4. The device of claim 3, wherein a set-point prestressing force is reached when the plug-in wedge (26) is in a terminal position, in which a stop collar (30) of the plug-in wedge (26) strikes a rim of the opening (28) of the plug strip (14).

5. The device of claim 4, wherein the plug-in wedge (26) protrudes away from a side face, pointing toward the plug strip (14), of a clamping bracket (18) supported on the housing half shell (1) counter to the action of the prestressing force, and wherein a retaining peg (20) is provided on each of the two ends of the plug strip (14), the retaining pegs (20) on the one hand being guided in a groove (24) embodied in the plug strip (14) and on the other being checked by a respective hook (22) protruding downward from the top wall (8) of the housing half shell (1).

6. The device of claim 5, wherein the plug strip (14) is retained in a direction transverse to the prestressing direction by the mounted clamping bracket (18) on the side wall (16) of the housing half shell (1).

7. The device of claim 6, wherein the stop faces comprise stop strips (34) which are formed onto the clamping bracket (18) and which are disposed successively along its length in spaced-part fashion and contact an outer circumferential surface of the ring seal (4) or are located opposite it at a slight spacing.

8. The device of claim 7, wherein the stop faces comprise support ribs (36), embodied on the side wall (16) of the housing half shell (1), which ribs are disposed spaced apart and aligned one after the other, parallel to the plug strip (14).

* * * * *